US007884771B2

(12) United States Patent
Tseng et al.

(10) Patent No.: US 7,884,771 B2
(45) Date of Patent: Feb. 8, 2011

(54) ANTENNA

(75) Inventors: Kuan-Hsueh Tseng, Taipei (TW); Yi-Ling Chiu, Taipei (TW); Chia-Tien Li, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 0 days.

(21) Appl. No.: 12/614,302

(22) Filed: Nov. 6, 2009

(65) Prior Publication Data

US 2010/0053016 A1 Mar. 4, 2010

Related U.S. Application Data

(63) Continuation of application No. 11/674,055, filed on Feb. 12, 2007, now Pat. No. 7,714,788.

(30) Foreign Application Priority Data

Jul. 4, 2006 (TW) ..... 95124300 A

(51) Int. Cl.
*H01Q 1/24* (2006.01)
*H01Q 1/50* (2006.01)

(52) U.S. Cl. ..... 343/702; 343/700 MS; 343/850; 343/846; 343/820

(58) Field of Classification Search ..... None
See application file for complete search history.

(56) References Cited

U.S. PATENT DOCUMENTS

| | | | | |
|---|---|---|---|---|
| 6,424,304 | B1 * | 7/2002 | Jan et al. | 343/702 |
| 6,781,553 | B2 * | 8/2004 | Iguchi et al. | 343/725 |
| 6,864,845 | B2 * | 3/2005 | Kuo et al. | 343/702 |
| 7,148,849 | B2 * | 12/2006 | Lin | 343/700 MS |
| 7,289,071 | B2 * | 10/2007 | Hung et al. | 343/702 |
| 7,333,067 | B2 * | 2/2008 | Hung et al. | 343/770 |
| 7,696,931 | B2 * | 4/2010 | Kim et al. | 343/702 |
| 7,714,788 | B2 * | 5/2010 | Tseng et al. | 343/702 |
| 2003/0234742 | A1 * | 12/2003 | Tai et al. | 343/700 MS |
| 2004/0130493 | A1 * | 7/2004 | Horita et al. | 343/702 |
| 2005/0134509 | A1 * | 6/2005 | Lin | 343/702 |
| 2005/0190108 | A1 * | 9/2005 | Lin et al. | 343/702 |

* cited by examiner

*Primary Examiner*—Trinh V Dinh

(57) ABSTRACT

An antenna comprises a ground element, a transmission element, a conductive element and a coupling element. The conductive element connects the ground element and the transmission element. The coupling element extends from the conductive element substantially parallel to the transmission element, wherein the coupling element is located on a first plane, the transmission element is located on a second plane, and the second plane is parallel to the first plane.

6 Claims, 5 Drawing Sheets

ANTENNA

This application is a continuation of U.S. application Ser. No. 11/674,055, now U.S. Pat. No. 7,714,788, filed Feb. 12, 2007, the entire disclosure of which is hereby incorporated by reference.

BACKGROUND OF THE INVENTION

1. Field of the Invention

The invention relates to an antenna, and in particular to a wideband antenna.

2. Description of the Related Art

FIG. 1*a* shows a conventional antenna, comprising a ground element 10, a conductive element 20 and a transmission element 30. Conductive element 20 is connected to ground element 10, and transmission element 30 is connected to conductive element 20.

With reference to FIG. 1*b*, when conventional antenna 1 transmits a WWAN (Wireless Wide Area Network) signal, antenna 1 provides a bandwidth between 850-1050 MHz and 1600-2100 MHz, wherein bandwidth is defined as signals having VSWR (Voltage Standing Wave Ratio) lower than 4.

Current antenna transmission requirements, however, dictate 900 MHz, 1800 MHz, 1900 MHz and 2100 MHz signals via a single transmission device. Bandwidths of conventional antennae cannot satisfy this requirement.

BRIEF SUMMARY OF THE INVENTION

A detailed description is given in the following embodiments with reference to the accompanying drawings.

An antenna comprises a ground element, a radiating element, a conductive element and a coupling element. The conductive element connects the ground element and the radiating element. The coupling element extends from the conductive element substantially parallel to the radiating element, wherein the coupling element is located on a first plane, the radiating element is located on a second plane, and the second plane is parallel to the first plane.

The invention provides increased bandwidth and improved transmission to satisfy future antenna transmission requirements.

The antenna of the invention can transmit Wireless Wide Area Network (WWAN) signal, Wireless Local Area Network (WLAN) signal and Worldwide Interoperability for Microwave Access (WIMAX) signal.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
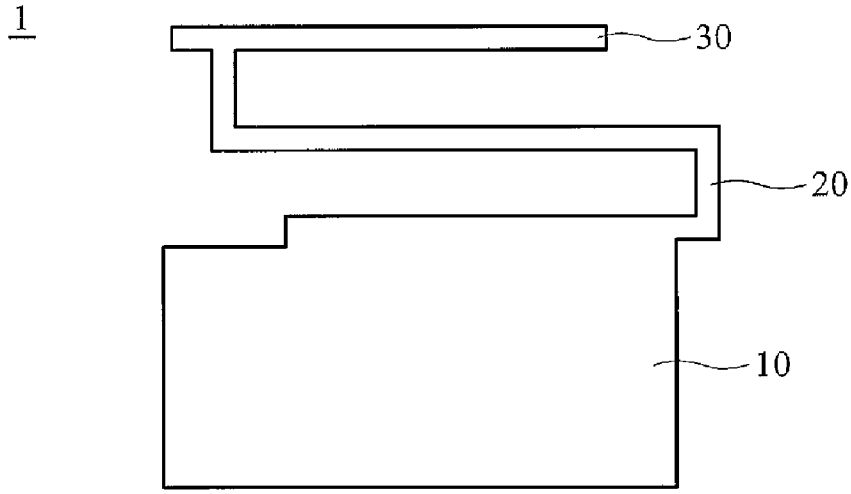
FIG. 1a (RELATED ART)
FIG. 1*a* shows a conventional antenna.
Figure 1B:
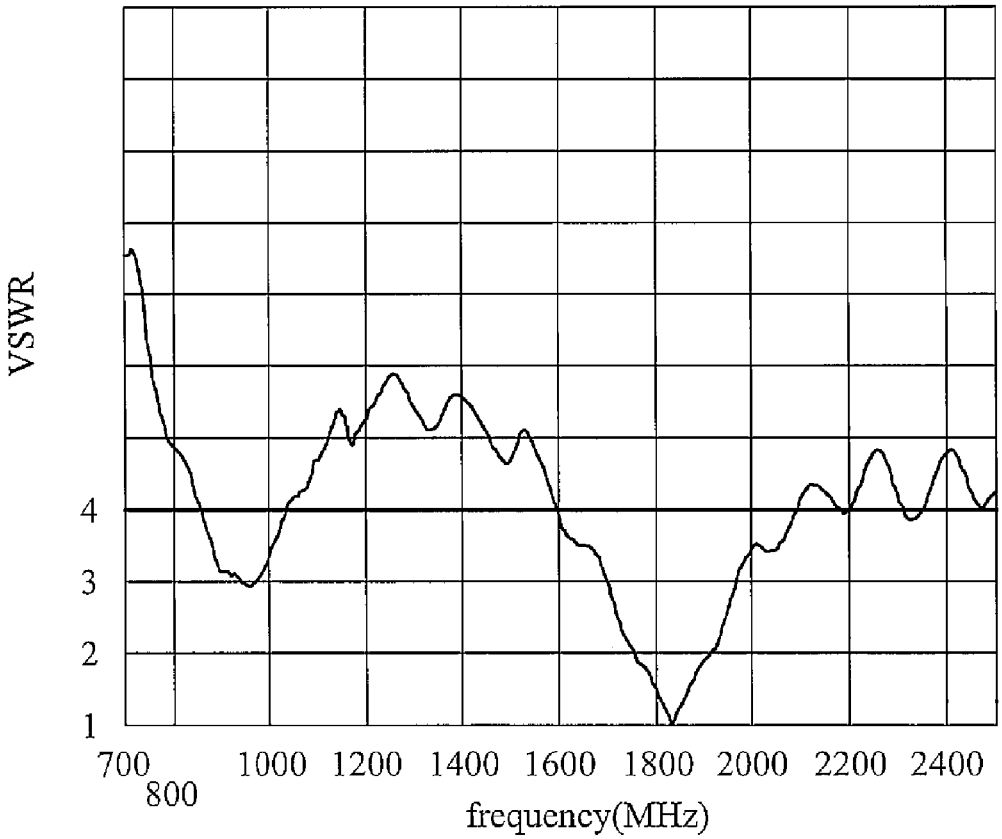
FIG. 1b (RELATED ART)
FIG. 1*b* shows the transmission of a conventional antenna.
Figure 2A:
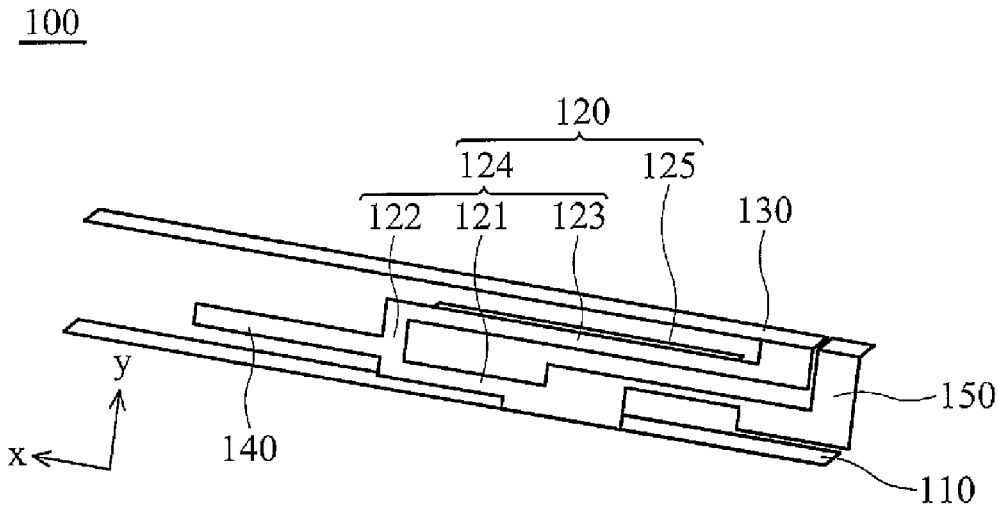
FIG. 2*a* shows an antenna of a first embodiment of the invention.

FIG. 2*a* shows an antenna 100 of a first embodiment of the invention, comprising a ground element 110, a conductive element 120, a radiating element 130, a first matching element 140 and a second matching element 150, wherein the first matching element 140 and the second matching element 150 is capable of adjusting the matching effect of the antenna and allowing the antenna transmitting and receiving wireless signals with frequency between 1710-2179 MHz. The conductive element 120 is connected to the ground element 110. The radiating element 130 is connected to the conductive element 120. The conductive element 120 comprises a conductive portion 124 and a coupling portion 125. The conductive portion 124 connects the ground element 110 and the radiating element 130. The coupling portion 125 is connected to the conductive portion 124 corresponding to the radiating element 130.

Figure 2B:
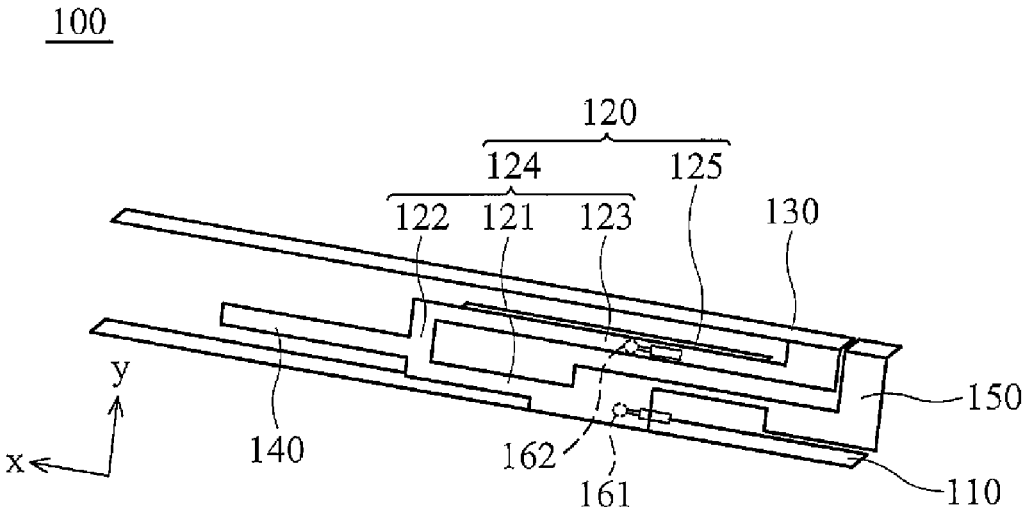
FIG. 2*b* shows a feed point and a ground point of the first embodiment of the invention.
Figure 2C:
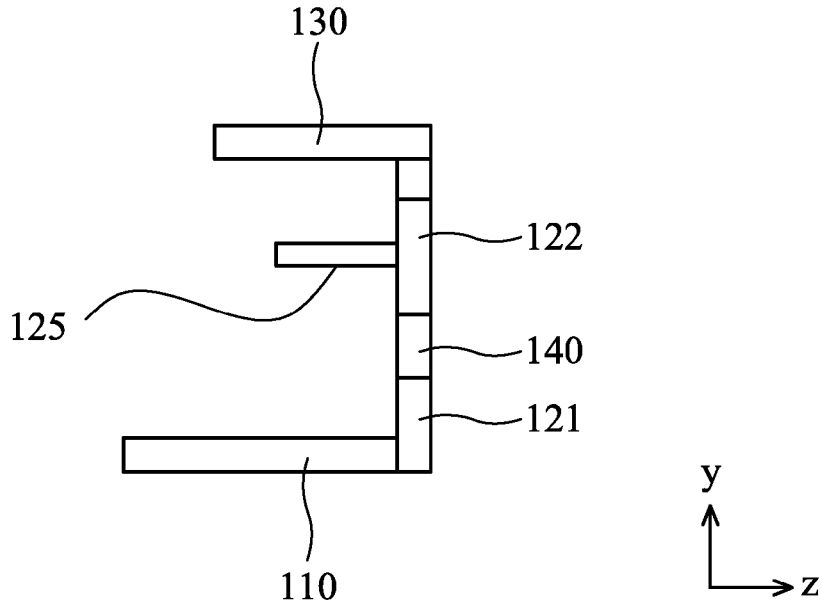
FIG. 2*c* is a y-z plane view of the antenna of the first embodiment of the application
Figure 2D:
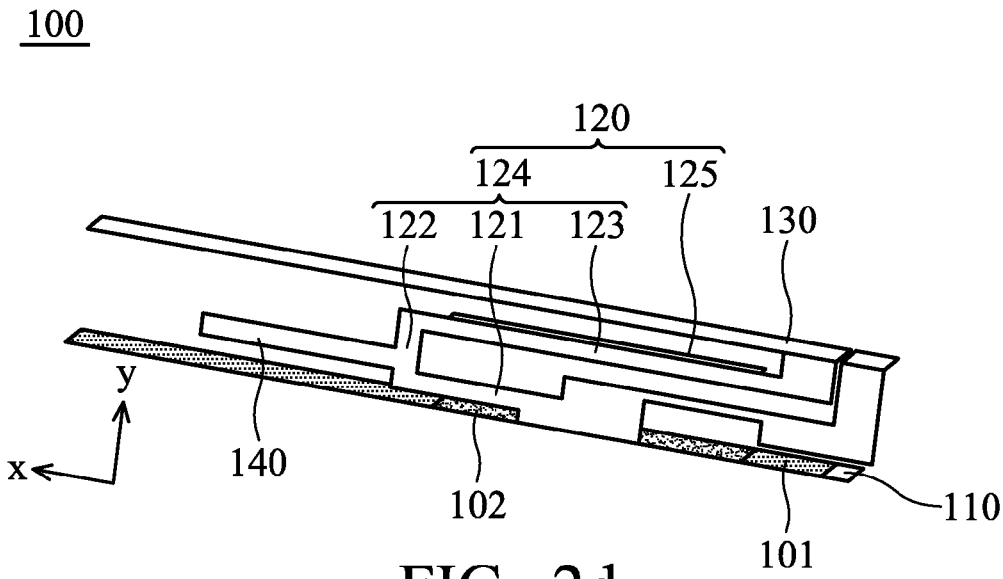
FIG. 2*d* shows normal projection regions of a radiating element and a coupling portion of the first embodiment of the application

With reference to FIGS. 2*a*, 2*c* and 2*d*, the coupling portion 125 is located on a first plane, and the radiating element 130 is located on a second plane parallel to the first plane. The conductive portion 124 is located on a third plane perpendicular to the first plane. The ground element 110 is located on a fourth plane parallel to the first plane.

The conductive portion 124 comprises a first section 121, a second section 122 and a third section 123. The first section 121 is connected to the ground element 110. The second section 122 is connected to the first section 121. The third section 123 connects the second section 122 and the radiating element 130. The first section 121 is L-shaped. A first end of the first section 121 is connected to the ground element 110, and a second end of the first section 121 extends in a first direction x connected to the second section 122. The second section 122 is longitudinal extending in a second direction y perpendicular to the first direction x. The third section 123 is L-shaped, a third end of the third section 123 is connected to the radiating element 130, and a fourth end of the third section 123 extends in the first direction x connected to the second section 122. With reference to FIG. 2*d*, a normal projection region 101 of the radiating element is defined as a projection region of the radiating element 130 projected along a direction perpendicular to the x-z plane, and a normal projection region 102 of the coupling portion is defined as a projection region of the coupling portion 125 projected along a direction perpendicular to the x-z plane.

The radiating element 130 extends in the first direction x.

The first matching element 140 is connected to the second section 122 located on the third plane extending in the first direction x.

The second matching element 150 is L-shaped, comprising a fifth end and a sixth end. The fifth end is connected to the first section 121. The sixth end extends in the second direction y. The second matching element 150 nears the third section 123, and crosses the third and second planes.

When the antenna 100 transmits a first signal (824~960 MHz), the radiating element 130 transmits the first signal and couples the coupling portion 125. When the antenna 100 transmits a second signal (1710~2170 MHz), the first matching element 140 and the second matching element 150 is capable of adjusting the matching effect of the antenna 100 and transmitting and receiving the second signal.

With reference to FIG. 2*b*, the antenna 100 comprises a ground point 161 and a feed point 162. The ground point 161 is located on the first section 121. The feed point 162 is located on the third section 123.

Figure 3A:
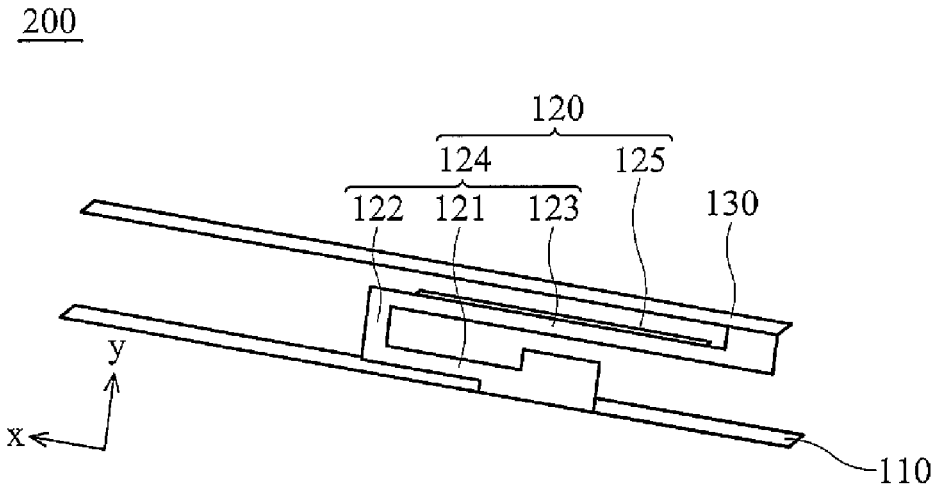
FIG. 3*a* shows an antenna of a second embodiment of the invention.
Figure 3B:
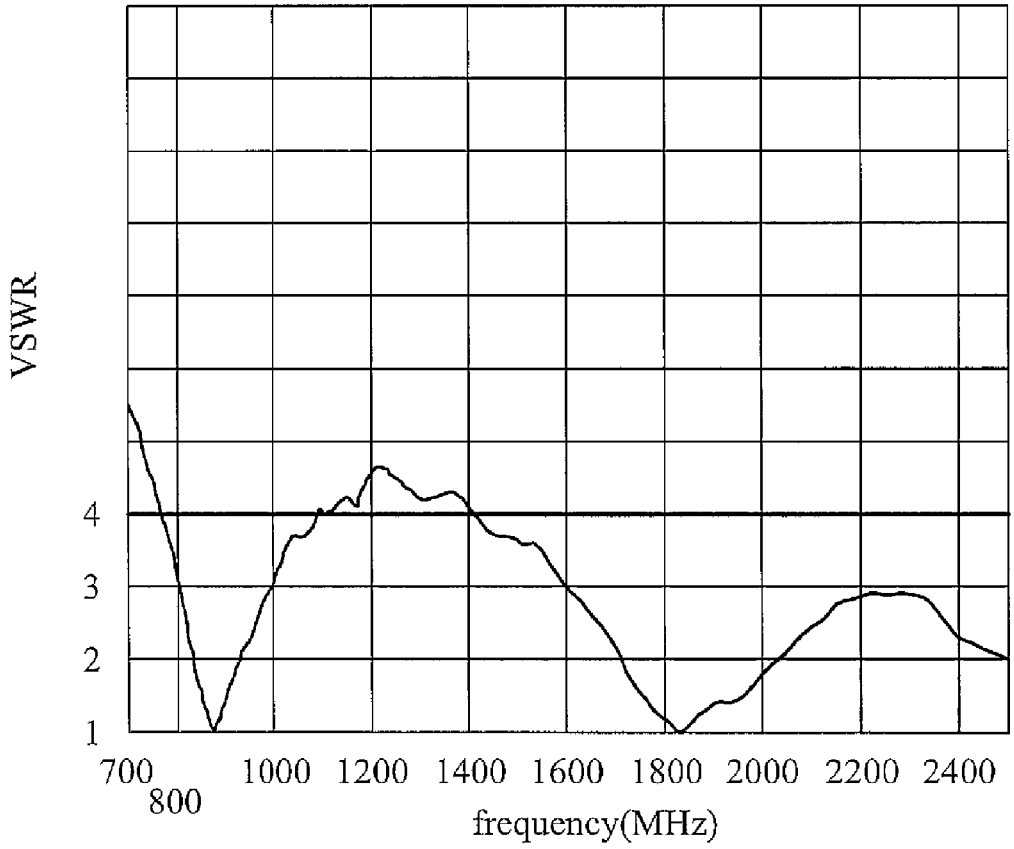
FIG. 3*b* shows the transmission of the second embodiment of the invention.

FIG. 3*a* shows an antenna 200 of a second embodiment of the invention, from which the first matching element 140 and the second matching element 150 are eliminated. FIG. 3*b* shows the transmission of the antenna 200, which provides increased bandwidth nearing 900 MHz and 1800 MHz.

Figure 4A:
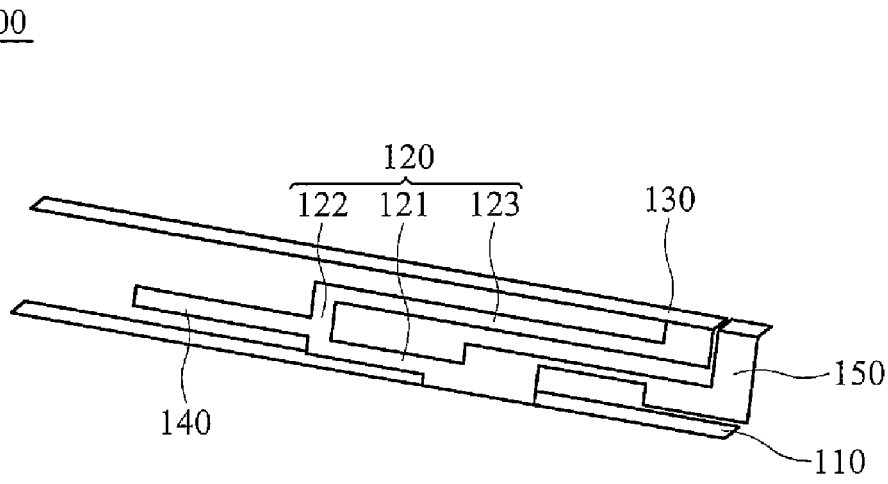
FIG. 4*a* shows an antenna of a third embodiment of the invention.
Figure 4B:
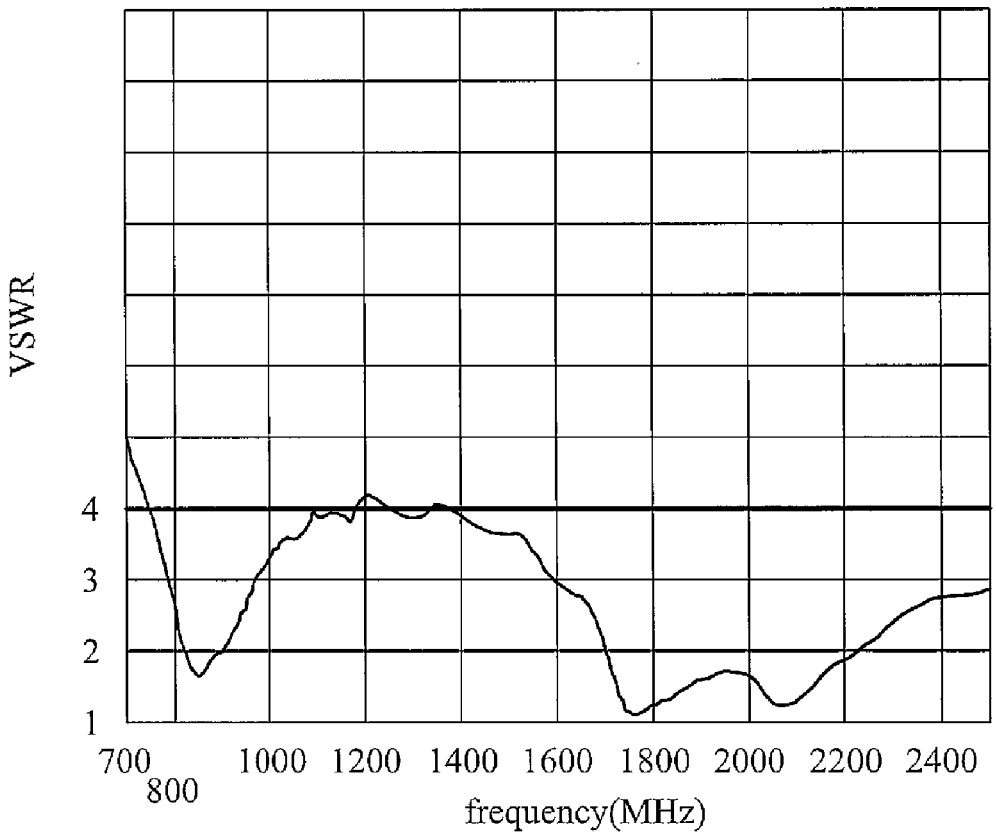
FIG. 4*b* shows the transmission of the third embodiment of the invention.

FIG. 4*a* shows an antenna 300 of a third embodiment of the invention. Relative to the first embodiment, the coupling portion 125 is eliminated. When the antenna 300 transmits a first signal (824~960 MHz), the transmission element 300 transmits the first signal via the transmission 130. When the antenna 100 transmits a second signal (1710~2170 MHz), the first matching element 140 and the second matching element 150 is capable of adjusting the matching effect of the antenna 100 and transmitting and receiving the second signal. FIG. 4*b* shows the transmission of the antenna 300, which provides increased bandwidth nearing 900 MHz and 1800 MHz.

The invention provides increased bandwidth and improved transmission to satisfy future antenna transmission requirements.

The antenna of the invention can transmit Wireless Wide Area Network (WWAN) signal, Wireless Local Area Network (WLAN) signal and Worldwide Interoperability for Microwave Access (WIMAX) signal.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a ground element;

a conductive element, connected to the ground element, wherein the conductive element comprises a conductive portion and a coupling portion, and the coupling portion is connected to the conductive portion;

a radiating element, connected to the conductive element extending in a first direction, wherein a normal projection region of the radiating element on the ground element overlaps a normal projection region of the coupling portion on the ground element;

a first matching element, connected to the conductive element extending in the first direction; and a second matching element, wherein the second matching element is L-shaped and comprises a first end and a second end, the first end is connected to the conductive element, and the second end extends in a second direction.

2. The antenna as claimed in claim 1, wherein the conductive portion comprises a first section, a second section and a third section, the first section connected to the ground element, the second section connected to the first section, the third section connected to the second section, and the radiating element connected to the third section.

3. The antenna as claimed in claim 2, wherein the first matching element is connected to the second section.

4. The antenna as claimed in claim 2, wherein the first end is connected to the first section.

5. The antenna as claimed in claim 2, wherein the coupling element is located on a first plane, the radiating element is located on a second plane, the second plane is parallel to the first plane, the conductive element is located on a third plane, and the third plane is perpendicular to the second plane.

6. The antenna as claimed in claim 5, wherein the second matching element crosses the second plane and the third plane.

* * * * *